US009782818B2

(12) United States Patent
Broadbent et al.

(10) Patent No.: US 9,782,818 B2
(45) Date of Patent: Oct. 10, 2017

(54) DIE SHOE ASSEMBLY WITH BEARING SURFACE MECHANISM, AND DIE FOR USE THEREWITH

(75) Inventors: Joseph Daniel Broadbent, Stacy, MN (US); Bradley P. Schulte, Osceola, WI (US); Brian J. Lee, Elk River, MN (US)

(73) Assignee: Wilson Tool International Inc., White Bear Lake, MN (US)

( * ) Notice: Subject to any disclaimer, the term of this patent is extended or adjusted under 35 U.S.C. 154(b) by 866 days.

(21) Appl. No.: 13/155,876

(22) Filed: Jun. 8, 2011

(65) Prior Publication Data

US 2012/0312067 A1 Dec. 13, 2012

(51) Int. Cl.

| | |
|---|---|
| ***B21D 37/04*** | (2006.01) |
| ***B21D 28/34*** | (2006.01) |
| ***B21D 37/14*** | (2006.01) |

(52) U.S. Cl.

CPC ..... *B21D 37/04* (2013.01); *B21D 28/34* (2013.01); *B21D 37/14* (2013.01); *Y10T 29/49826* (2015.01)

(58) Field of Classification Search

CPC ..... B21D 37/14; B21D 37/04; B21D 5/0236; B21D 28/34; B21D 37/10

USPC ..... 72/462, 481.1, 444, 482.1, 482.2, 481.6

See application file for complete search history.

(56) References Cited

U.S. PATENT DOCUMENTS

| | | | | |
|---|---|---|---|---|
| 2,364,401 A | | 12/1944 | Stellin | |
| 3,460,500 A | | 8/1969 | McCoy | |
| 3,535,967 A | | 10/1970 | Whistler | |
| 3,779,122 A | | 12/1973 | Sawvell | |
| 4,472,959 A | * | 9/1984 | Fencl | B21D 41/04 72/402 |
| 4,570,327 A | | 2/1986 | Klingel | |
| 4,951,375 A | | 8/1990 | Erlenmaier | |
| 5,042,352 A | | 8/1991 | Lux | |
| 5,245,854 A | * | 9/1993 | Bruggink et al. | 72/481.7 |
| 6,082,166 A | | 7/2000 | Marin | |
| 6,167,742 B1 | | 1/2001 | Marin | |
| 6,463,839 B2 | | 10/2002 | Ohtsuka | |

(Continued)

FOREIGN PATENT DOCUMENTS

| | | |
|---|---|---|
| CN | 1519068 A | 8/2004 |
| EP | 311857 A1 | 4/1989 |

(Continued)

OTHER PUBLICATIONS

International Search Report from the International Searching Authority for International Application No. PCT/US2012/026135, mailed May 31, 2012, 5 pages, European Patent Office, Rijswijk, The Netherlands.

(Continued)

*Primary Examiner* — R. K. Arundale
*Assistant Examiner* — Mohammad Yusuf
(74) *Attorney, Agent, or Firm* — Fredrikson & Byron, P.A.

(57) ABSTRACT

An apparatus meant to contain a die portion of a punch and die set whether in a loading cartridge or in machine operating position, wherein a key is used with a die shoe to prevent lateral movement of the die regardless of extent by which the die is sharpened and continued to be used with the die shoe, and wherein a die is used with the die shoe to minimize jagged or sharp edges being created from sharpening processes thereof.

42 Claims, 14 Drawing Sheets

(56) References Cited

U.S. PATENT DOCUMENTS

| | | | | |
|---|---|---|---|---|
| 6,807,838 | B2 | 10/2004 | Iwaya | |
| 6,928,852 | B2 * | 8/2005 | Enderink | 72/481.1 |
| 7,004,008 | B2 * | 2/2006 | Harrington et al. | 72/481.1 |
| D592,685 | S | 5/2009 | Ferry | |
| 7,634,935 | B2 * | 12/2009 | Mazzocchi | 72/481.1 |
| 7,669,453 | B2 | 3/2010 | Palick | |
| 7,721,586 | B2 * | 5/2010 | Pabich et al. | 72/481.1 |
| 7,874,194 | B2 | 1/2011 | Shimota | |
| 2004/0163442 | A1 * | 8/2004 | Gascoin | 72/482.2 |
| 2008/0216551 | A1 * | 9/2008 | Shimota et al. | 72/482.6 |
| 2008/0295567 | A1 * | 12/2008 | Thielges et al. | 72/481.7 |
| 2009/0266134 | A1 | 10/2009 | Huang | |
| 2009/0320550 | A1 * | 12/2009 | Lee et al. | 72/462 |
| 2010/0064762 | A1 * | 3/2010 | Shimota et al. | 72/481.6 |
| 2010/0095824 | A1 | 4/2010 | Laib | |
| 2011/0247389 | A1 * | 10/2011 | Rouweler et al. | 72/481.1 |

FOREIGN PATENT DOCUMENTS

| | | | |
|---|---|---|---|
| EP | 1046438 | A1 | 10/2000 |
| JP | S5630417 | Y2 | 7/1981 |
| JP | S57-21431 | U | 2/1982 |
| JP | 3064759 | U | 1/2000 |

OTHER PUBLICATIONS

Written Opinion of the International Searching Authority for International Application No. PCT/US2012/026135, mailed May 31, 2012, 6 pages, European Patent Office, Rijswijk, The Netherlands.

International Preliminary Report on Patentability (Chapter I of the Patent Cooperation Treaty) from the International Bureau of WIPO for International Application No. PCT/US2012/026135, Dec. 10, 2013, 7 pages, Geneva, Switzerland.

* cited by examiner (PRIOR ART)

(PRIOR ART)

DIE SHOE ASSEMBLY WITH BEARING SURFACE MECHANISM, AND DIE FOR USE THEREWITH

FIELD OF THE INVENTION

The invention relates to punch press tooling, and more particularly to an apparatus meant to contain a die portion of a punch and die set whether in a loading cartridge or in machine operating position.

BACKGROUND

Machine tools are usually adapted for being used with many different tool sets. A typical tool set includes a punch and a corresponding die, wherein a stripper plate is also commonly included as part of the tool set. In processing a workpiece (e.g., a piece of sheet metal), it is common to use several different tool sets. In some cases, once a first tool set has been used, it is exchanged for a second tool set, and then a third, and so on. Once a first workpiece has been fully processed using the desired sequence of tool sets, a second workpiece may be processed, in some cases beginning again with the first tool set.

The tool sets used on a machine tool are often stored in cartridges. Some cartridges may be stored in the machine tool, while others may be kept nearby. When several different tool sets (e.g., of different size and/or shape) are used for a job, the machine tool is commonly provided with cartridges respectively holding the different tool sets. Not only do the cartridges store the tools, they may also be used to facilitate loading and unloading the tools on the machine tool. For example, when it is desired to use a particular tool set, a cartridge holding that tool set is moved to a mounting position on the machine tool. At the mounting position, the tools are automatically removed from the cartridge and loaded onto the machine tool, with the die held in position by a corresponding die shoe. Once use of that tool set is finished, its tools are unloaded from the machine tool and loaded back onto the cartridge. The cartridge is then moved away from the mounting position. Then, a different cartridge (holding another tool set) can be moved to the mounting position so that a new set of tools can be used by the machine tool. This process is repeated for as many different tool sets as are needed for a given job. In some cases, the machine tool includes an elongated rail for storing the cartridges. The cartridges, for example, can be slidably engaged with the rail such that they can be slid back and forth to and from the mounting position. In other cases, the cartridges are stored in a rotary storage system, a round carousel, or a stacked storage system. The mounting and dismounting of tool sets using cartridges is described in U.S. Pat. No. 4,951,375. This '375 patent is incorporated herein by reference to the extent it shows and describes the structure of an exemplary machine tool with a cartridge guidance system.

As is known with such cartridges, a die is held therein via a die shoe, with the die shoe and corresponding die being simultaneously loaded onto the machine tool. As illustrated in FIGS. 1 and 2, a cartridge 10 is shown holding a die shoe 12, wherein the shoe 12 defines an inner recess 14 sized to accommodate a die 16, with the die shoe recess 14 having a outer surface 18 sized to mate with the outer side surface 20 of the die 16. The die 16 is often retained from rotation in the die shoe recess 14 via a key 22 of the die shoe 12. As shown, the key 22 has a portion 24 (e.g., an upper portion) that at least partially lies within the die shoe recess 14. As is known, dies (such as the die 16) are generally configured with a key channel 26 that extends vertically along the die outer side surface 20. Accordingly, upon being placed in a die shoe, such as the die shoe 12, the die 16 is positioned such that its vertical key channel 26 is aligned with the key 22. In turn, the key's upper portion 24 slides within the die's key channel 26 and, in turn, contacts side surfaces of the channel 26, thereby preventing rotation of the die 16 within the shoe 12.

One problem encountered to date with such above-described assembly between die shoe and die is further depicted in FIGS. 2-5. As is known, following sharpening processes of the die 16, the die 16 is normally brought back to its original height in the die shoe 12 with use of one or more shims 28 positioned between the die 16 and die shoe 12. With use of a limited amount of shims 28, as shown in FIG. 2, there often remains contact between the die outer side surface 20 and the recess outer surface 18 at key side 30 of the die shoe 12. However, with further sharpening of the die 16, and subsequently more shims 28 being positioned between the die 16 and shoe 12 (as illustrated in FIG. 3), portions of the die 16 are raised to heights 32 (as illustrated in FIG. 4) at which there is no longer appreciable contact between the die outer side surface 20 and the recess outer surface 18 at the key side 30 of the die shoe 12. Consequently, the die 16 can become ajar from the die shoe 12. As a result, the die 16 would be free to move laterally, with a likelihood that the die 16 (along with one or more of the shims 28 nearest the die 16) potentially slides out from the die shoe recess 14. Such event is depicted in FIG. 5, wherein the die 16 and shims 28 (collectively referenced as 34) are shown starting to slide laterally out of the recess 14, and coming into contact with the key's portion 24 within the die's key channel 26.

In light of the above, the outer surface 18 at the key side 30 of the die shoe 12, or key-side bearing surface of the shoe 12, is found to be the limiting factor for how much the die 16 can be sharpened and shimmed, while still being held in workable position in the shoe 12. To that end, in the case of loading a tool set in a machine tool from a cartridge, if such tool set involves a die shoe from which a die has become ajar, a machine sensor would be known to identify the situation and return an error message to the operator. Consequently, current cartridges can be used with dies only so long as sufficient retaining contact is made between the die shoe bearing surface and the dies. Unfortunately, this results in dies needing to be replaced in such die shoes before the dies' usable lives are reached.

Additionally, a problem can arise during use of dies within the die shoes, particularly following sharpening of such dies. For example, when a die is sharpened, its edges can often become jagged. Such jagged edges are often found to interfere with workpieces being slid across the die's upper surface, with the workpieces catching against the edges. Such catching, or contact between a workpiece and the die's surface, can result in compromising the machining process, which stems from improper positioning of the workpiece, and in some cases, the movement of the die, depending on size of the workpiece. As a consequence, material ends up being scrapped and time is lost in the process.

Accordingly, when using cartridges, issues can develop with both corresponding die shoes and dies used therein. The present invention addresses these and other problems.

SUMMARY OF THE INVENTION

In certain embodiments of the invention, an apparatus for containing a die is provided. The apparatus comprises a die shoe defining an inner recess sized to accommodate a die. The recess is sized to mate with an outer surface of the die. The die shoe includes a key provided on one side of the die shoe. The key has an extension that projects away from the key. The extension is adapted to slide into a key channel of the die when the die is placed in the die shoe recess. The extension is adapted to limit lateral movement of the die so that the die is maintained in workable vertical alignment with the die shoe in event the die is raised to a height at which there is a lack of appreciable contact between the die and the one side of the die shoe.

In additional embodiments of the invention, an apparatus for containing a die is provided. The apparatus comprises a die shoe defining an inner recess sized to accommodate a die. The recess is sized to mate with an outer surface of the die. The die shoe includes a key provided on one side of the die shoe. The key includes a dynamic mechanism that projects away from the key and is adapted to slide into a key channel of the die when the die is placed in the die shoe recess. The mechanism is adapted to provide contact with a back wall of the key channel of the die and thereby prevent lateral movement of the die in event the die is raised to a height at which there is a lack of appreciable contact between the die and the one side of the die shoe.

In other embodiments of the invention, an apparatus for containing a die is provided. The apparatus comprises a die shoe defining an inner recess sized to accommodate a die. The recess is sized to mate with an outer surface of the die. The die shoe includes a key provided on one side of the die shoe. The key has an extension that projects away from the key and is adapted to slide into a key channel of the die when the die is placed in the die shoe recess. The extension comprises a first extension and a second extension. The first extension is adapted to be in close proximity to a back wall of the die key channel when the die is placed in the die shoe recess. The second extension is adapted to lie adjacent to key channels of one or more shims when the one or more shims are placed in the die shoe recess between the die and the die shoe. The first extension and the second extension form a stop there between, and the stop is configured to retain the one or more shims within the die shoe recess when the die is removed from the die shoe.

In additional embodiments of the invention, a method is provided for retaining a die in position within a die shoe, regardless of extent by which the die is raised out of the die shoe. The method comprises providing a die shoe defining an inner recess sized to accommodate a die. The recess is sized to mate with an outer surface of the die. The die shoe includes a key provided on one side of the die shoe. The key has an extension that projects away from the key. The method further comprises positioning the die on top of one or more shims in the die shoe recess. The die once positioned has a lack of appreciable contact with the one side of the die shoe. The extension of the key slides into a key channel of the die and is adapted to limit lateral movement of the die so that the die is maintained in workable vertical alignment with the die shoe.

In further embodiments of the invention, a die and an apparatus for containing the die are provided in combination. The combination comprises a die shoe defining an inner recess sized to accommodate the die. The recess is sized to mate with an outer surface of the die. The die shoe includes a key provided on one side of the die shoe. The key has an extension that projects away from the key. The combination further comprises a die provided in the die shoe recess. The die has an upper surface and a smooth profile extending from the upper surface. The profile comprises a smooth continuous portion of the die extending from the die's upper surface to at least about ⅕ of an original unsharpened height of the die. The key is positioned in a key channel of the die. The key extension is adapted to limit lateral movement of the die so that the die is maintained in workable vertical alignment with the die shoe in event of jarring contact between the die and a workpiece. The die is adapted to accommodate a plurality of sharpening processes along the die smooth continuous portion prior to reaching a handling groove in an outer side surface of the die. Said sharpening processes are less susceptible to forming jagged edges on the die upper surface.

DETAILED DESCRIPTION

Figure 1:
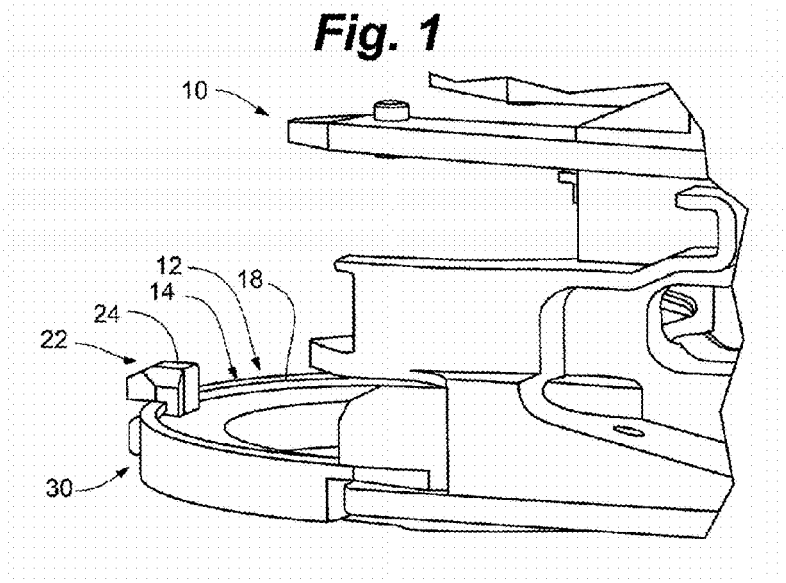
FIG. 1 is a partial perspective side view of a die shoe with key held in a tool set cartridge.
Figure 2:
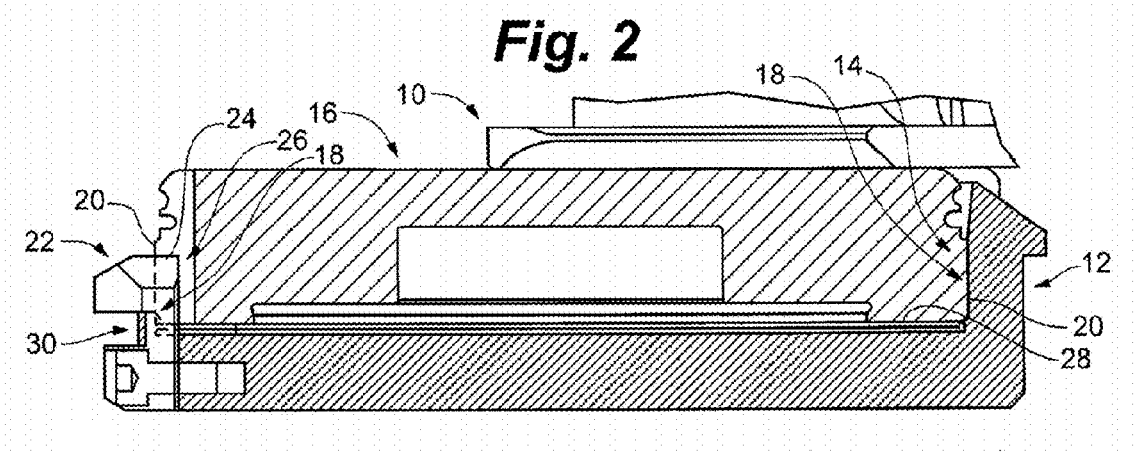
(PRIOR ART) Fig. 2
FIG. 2 is a cross-sectional side view of the die shoe and key of FIG. 1 with a die positioned in the die shoe and the die's height raised in relation to the die shoe via use of a quantity of shims and with transparent view of the key being shown.
Figure 3:
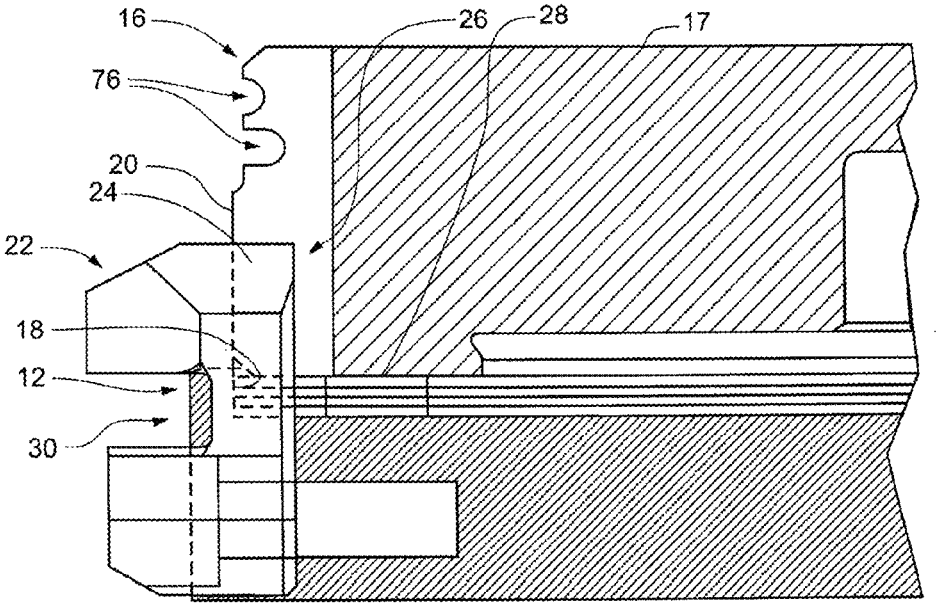
FIG. 3 is a partial cross-sectional view of the die shoe, key, and die of FIG. 2 with the die's height raised in relation to the die shoe via use of an increased quantity of the shims.
Figure 4:
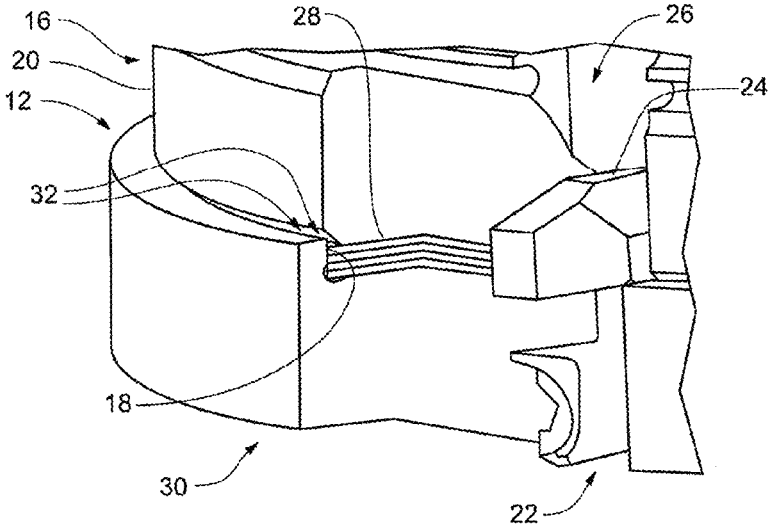
(PRIOR ART) Fig. 4
FIG. 4 is a partial perspective view of the die shoe, key, die, and shims of FIG. 3, showing a partial cutaway of such at a bearing surface of the die shoe.
Figure 5:
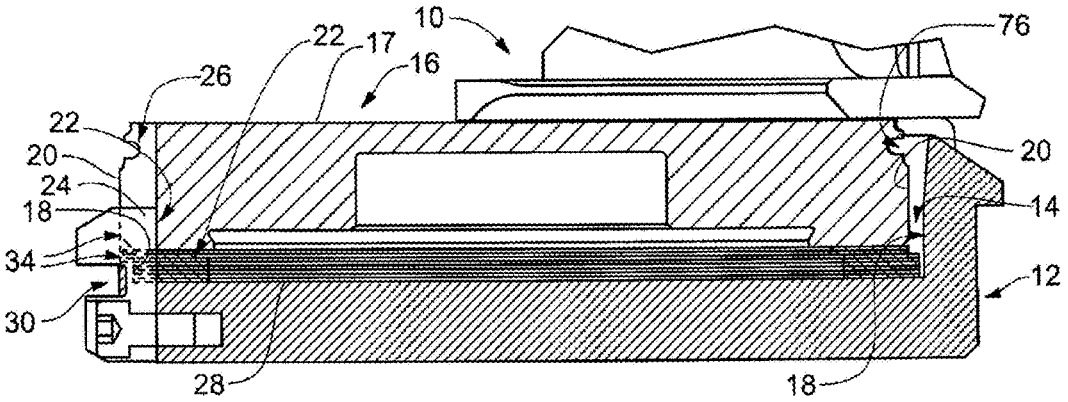
FIG. 5 is a further cross-sectional side view of the die shoe, key, and die of FIG. 2 with the die's height raised in relation to the die shoe via use of an increased quantity of the shims.

The following detailed description should be read with reference to the drawings, in which like elements in different drawings are numbered identically. The drawings depict selected embodiments and are not intended to limit the scope of the invention. It will be understood that embodiments shown in the drawings and described below are merely for illustrative purposes, and are not intended to limit the scope of the invention as defined in the claims.

As described above, when using cartridges, issues can develop with respect to the die shoe (and its bearing surface at the key side) in being able to retain the die therein over the life of the die. In addressing these issues, reference is made to FIGS. 6-12.

Figure 6:
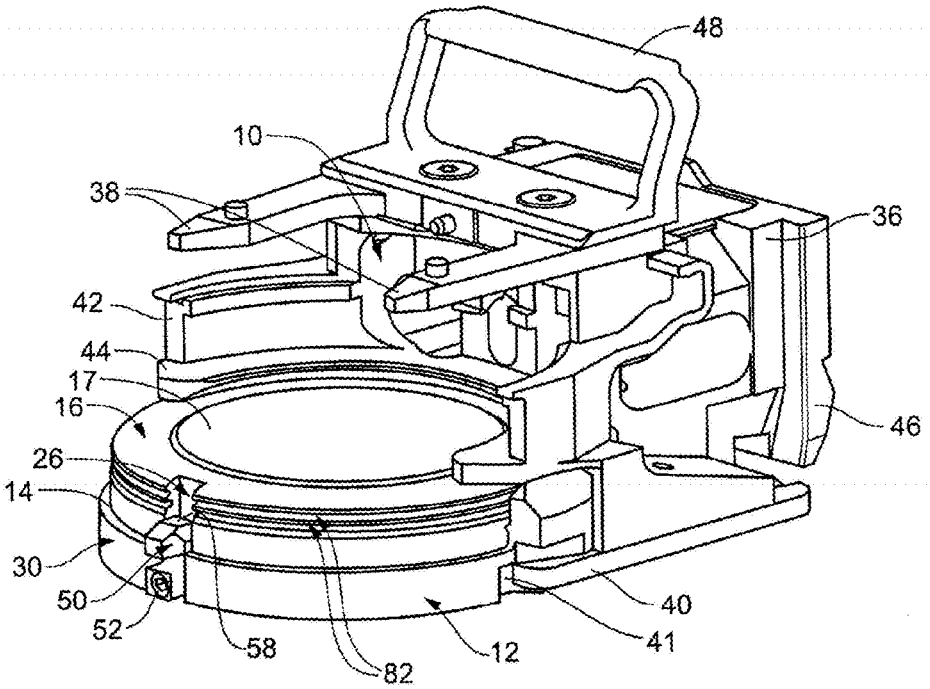
(PRIOR ART) Fig. 6
FIG. 6 is perspective view of a die shoe, key, and die therein, both held in a tool set cartridge, in accordance with certain embodiments of the invention.

In particular, with reference to FIG. 6, a die shoe and a die are shown in a tool set cartridge in accordance with certain embodiments of the invention. The cartridge 10 (as referenced above) has a main body 36, two punch-retention arms 38, and two die-retention arms 40 (one of which is not visibly shown), with the punch-retention arms 38 and the die-retention arms 40 generally spaced apart from each other. The punch-retention arms 38 are configured to be repeatedly engaged and disengaged with a punch (not shown), and the die-retention arms 40 are repeatedly engaged and disengaged with a die as shown (for example, with the die 16 detailed above). The die 16 is operatively engaged to the arms 40 via a die shoe (for example, the shoe 12 detailed above). As shown, a stripper locator base 42 can be further provided on the cartridge, located between the punch-retention arms 38 and the die-retention arms 40. The stripper locator base 42 can define a shelf 44 adapted to receive a partial extent of a stripper plate (not shown).

The cartridge 10 can optionally further include a rail-engagement portion 46 (as exemplarily shown), adapted to be attached to a rail (and/or to a mount body of a guidance system) of a machine tool. By virtue of this attachment, the cartridge 10 can be moved selectively toward or away from a tool mounting position. As shown, the rail-engagement portion 46 can optionally be located on a rear portion of the cartridge 10. Further, a handle 48 can be optionally provided on the cartridge 10, as exemplarily shown, to facilitate carrying the cartridge manually. The handle 48 can be attached (optionally removably) to the cartridge main body 36. The structure and functioning of tool set cartridges (conventional and otherwise) are further detailed in U.S. Pat. No. 7,669,453, which is incorporated herein by reference to the extent it shows and describes features and functioning of such cartridges.

With further reference to FIG. 6, the die-retention arms 40 can be generally mounted to the main body 36 such that the arms 40 have a limited range of movement toward and away from each other. In some cases, the arms 40 can be resiliently mounted (e.g., pivotally) to the main body 36 such that the arms 40 are resiliently biased toward a default configuration characterized by the arms being closer to each other than they are in any other configuration within their limited range of movement. In such cases, when the die shoe 12 is inserted between the arms 40, the arms 40 initially pivot outward to accept the shoe 12 there between, yet the bias of the arms 40 causes them to lock the die shoe 12 in place once ends of the arms 40 find corresponding seats 41 in the shoe 12.

As described above with reference to FIGS. 1-5 (and again summarized here), the conventional die shoe 12 defines an inner recess 14 sized to accommodate the die 16, with the die shoe recess 14 having a outer surface 18 sized to mate with the outer side surface 20 of the die 16. In addition, a key 22 of the die shoe 12 is used to prevent rotation of the die 16 within the die shoe recess 14. As is known, the die 16 needs to be sharpened periodically over its life to keep the die's cutting edge sharp and the die's upper surface generally planar for processing workpieces thereon. However, a consequence of such repeated sharpening is that the die's height is gradually reduced, which necessitates the die 16 to be raised to its original height in the shoe 12 for subsequent use in processing workpieces.

Raising the die 16 to its original height has been known to be accomplished via insertion of one or more shims 28 between the die 16 and die shoe 12. However, this eventually can result in the die 16 being raised beyond the height of the recess 14 at the key side 30 of the die shoe 12, facilitating a condition in which the die 16 can come free from the shoe 12. To that end, if the die 16 (and potentially one or more shims 28 beneath the die 16) is raised so as to become free from the die shoe 12, no mechanism in conventional die/die shoe assemblies has been provided to date for preventing lateral movement of the die 16 in relation to the shoe 12.

As illustrated in FIG. 6, the height of the die shoe 12 at the key side 30 can often be lower than the height of opposing and adjacent sides of the shoe 12. Such lower height at the key side 30 creates a larger opening for the die 16 to be positioned in the die shoe 12 when the shoe 12 is held within the cartridge 10. However, it also causes the key side 30 to be the limiting factor for how much the die 16 can be sharpened and shimmed, while still being held in position in the shoe 12. Put another way, dies can generally only be used with cartridges so long as sufficient contact is made between the dies and the key-side bearing surfaces of the die shoes carried by such cartridges. Unfortunately, this results in dies needing to be replaced in such die shoes before the dies' useful lives are reached. In addressing this problem, solutions have been explored whereby designs of the die shoe can be principally maintained, thereby providing a workable retrofit for systems already in the field, while also limiting amount of changeover needed in the ongoing manufacture of corresponding product.

As described above, beyond the outer surface 18 of the die shoe recess 14, the only other mechanism typically used in preventing movement of the die 16 is a key (e.g., key 22 as shown in FIGS. 1-5). To date, such key 22 of the die shoe 12 has been conventionally used for preventing the die 16 from rotating within the shoe 12. Such key 22, as described above, includes a portion 24, e.g., an upper portion, which lies within the die shoe recess 14. Consequently, when the die 16 is positioned in the die shoe 12, the key's portion 24 at least partially slides within the key channel 26 of the die 16, such that the sides of the key's portion 24 contact corresponding side surfaces of the die's key channel 26, thereby preventing rotation of the die 16 within the shoe 12. Accordingly, when mounted in the die shoe recess 14, the die 16 can be prevented from rotating therein via contact between side surfaces of the key 22 and corresponding side surfaces of the die's key channel 26.

As shown in FIG. 6, a new key 50 is provided for the die shoe 12 in accordance with certain embodiments of the invention. In general, the key 50 is formed of one or more standard tool steels, and can be operatively coupled to, or integral with, the die shoe 12. For example, the key 50 can be operatively coupled to the die shoe 12 via fastening means. In certain embodiments, the fastening means can involve a threaded fastener 52, extending through the key 50 and configured to align with a threaded bore 54 in the outer surface 56 of the die shoe 12; however, it should be appreciated that other fastening means can alternatively be used. As exemplified with respect to FIGS. 7-18, the key 50 can have differing combinations of features (as exemplified with key 50 in FIGS. 7A and 7B, with key 50' in FIGS. 8A and 8B, with key 50" in FIGS. 9-15, and with key 50'" in FIGS. 16-19).

Figure 7A:
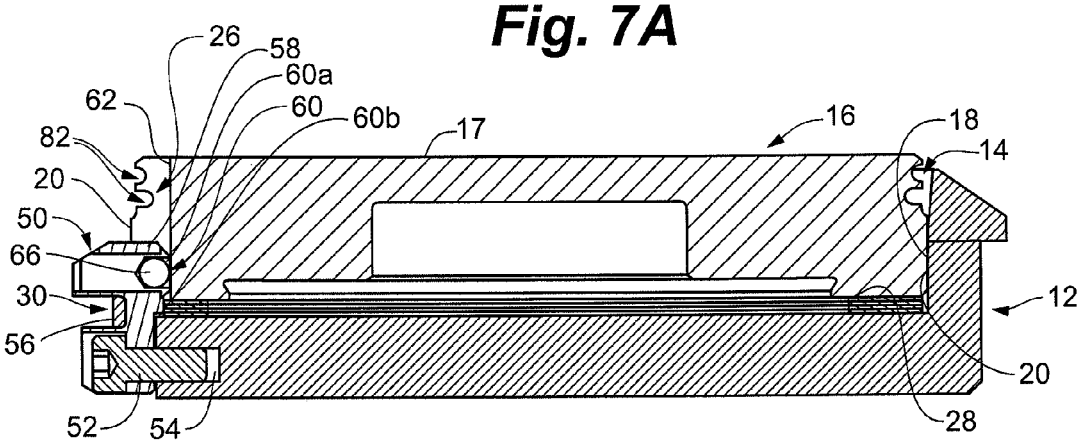
FIG. 7A is a cross-sectional side view of the die shoe, key, and the die of FIG. 6 with the die's height raised in relation to the die shoe via use of a quantity of shims in accordance with certain embodiments of the invention.
Figure 7B:
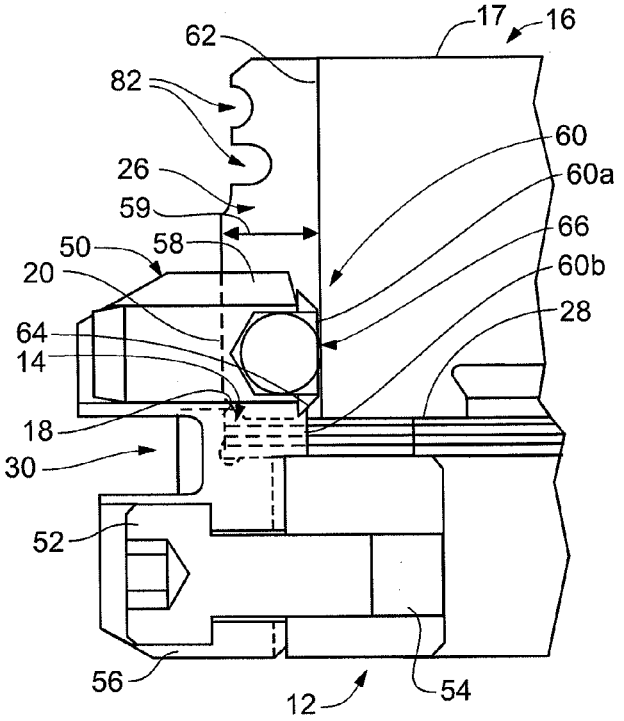
FIG. 7B is a partial view of the die shoe, key, die, and shims of FIG. 7A at a bearing surface of the die shoe, with transparent view of the key being shown.
Figure 8A:
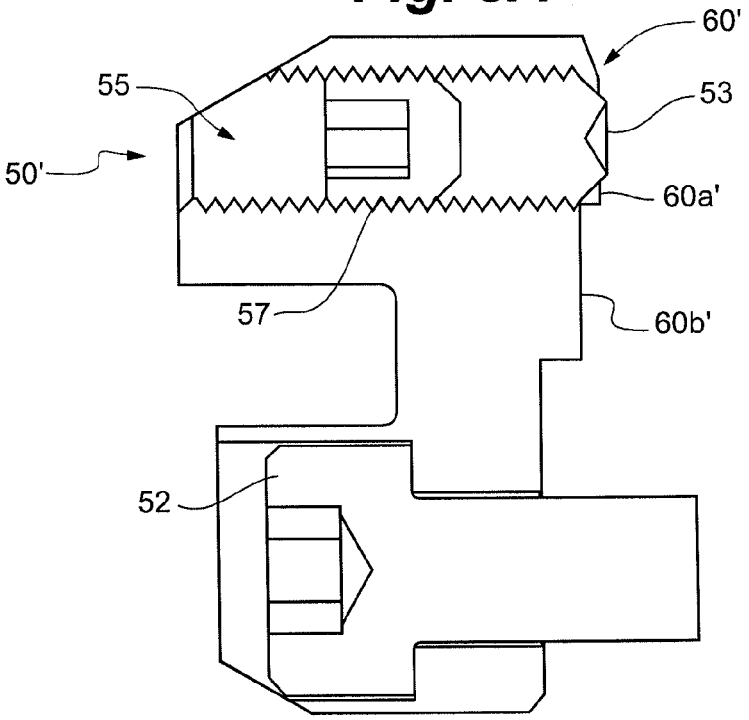
FIG. 8A is a cross-sectional view of an additional key in accordance with certain embodiments of the invention.
Figure 8B:
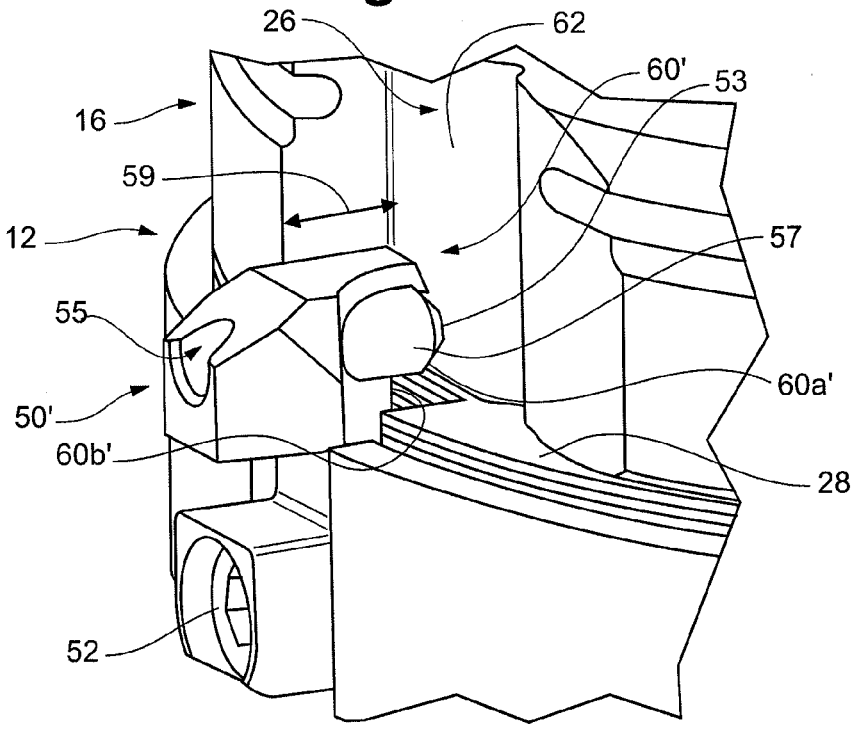
FIG. 8B is a partial perspective view of a die shoe, the key of FIG. 8A, a die, and shims in accordance with certain embodiments of the invention.
Figure 11:
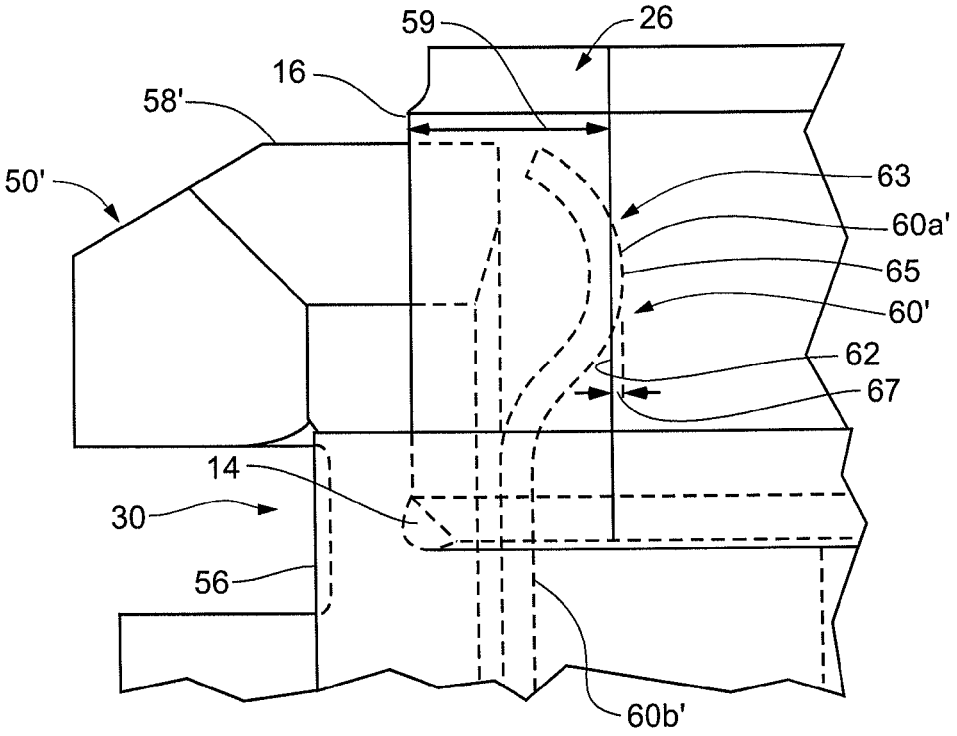
FIG. 11 is a cross-sectional side view of the die shoe and key of FIG. 10 with a die positioned in the die shoe in accordance with certain embodiments of the invention, with transparent view of the key being shown.
Figure 12:
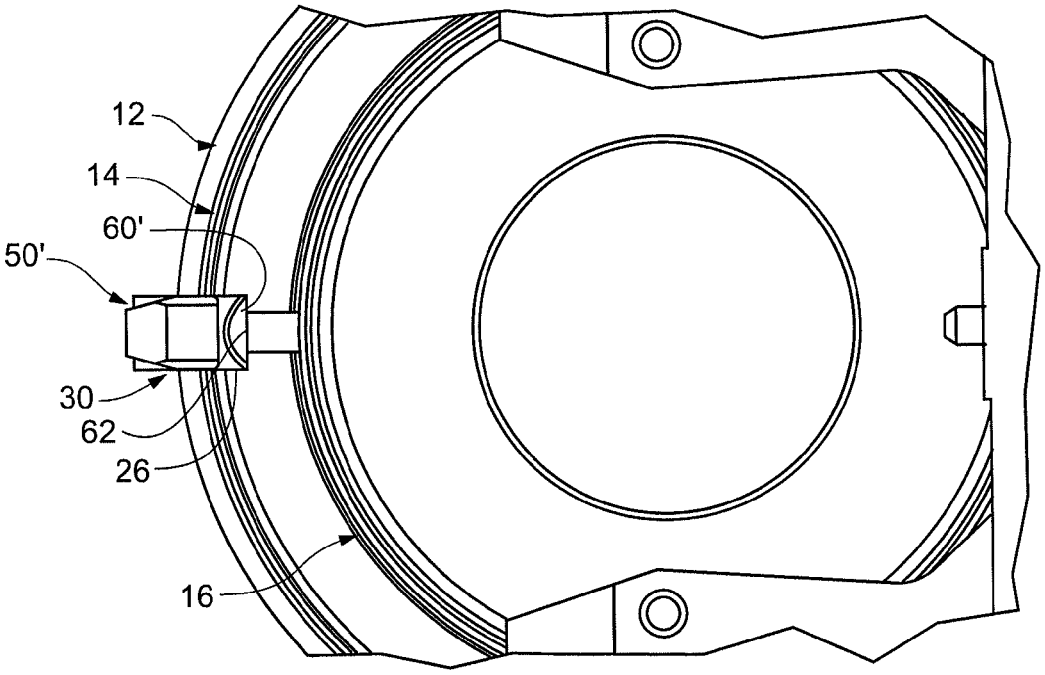
FIG. 12 is a top view of the die shoe, key, and die of FIG. 11.
Figure 16:
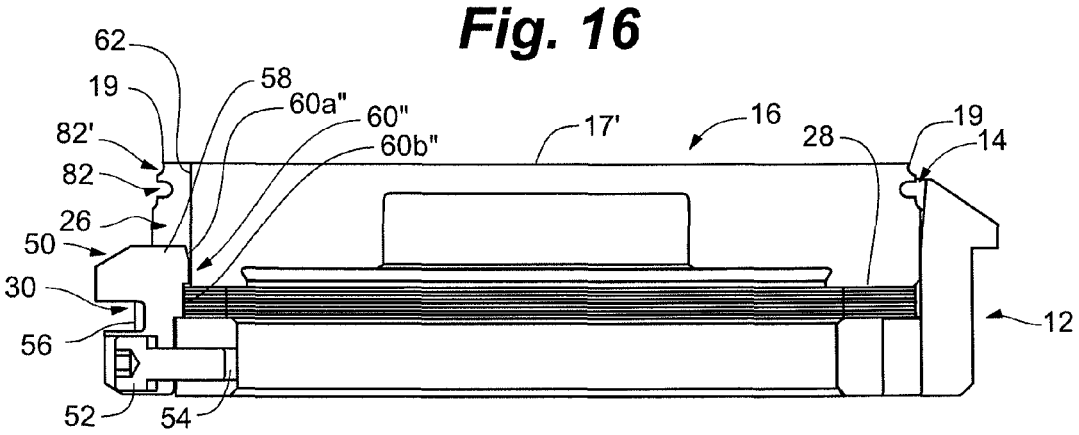
FIG. 16 is a cross-sectional side view of the die shoe and die of FIG. 7 and further key in accordance with certain embodiments of the invention, with the die's height raised in relation to the die shoe via use of a quantity of shims.
Figure 17:
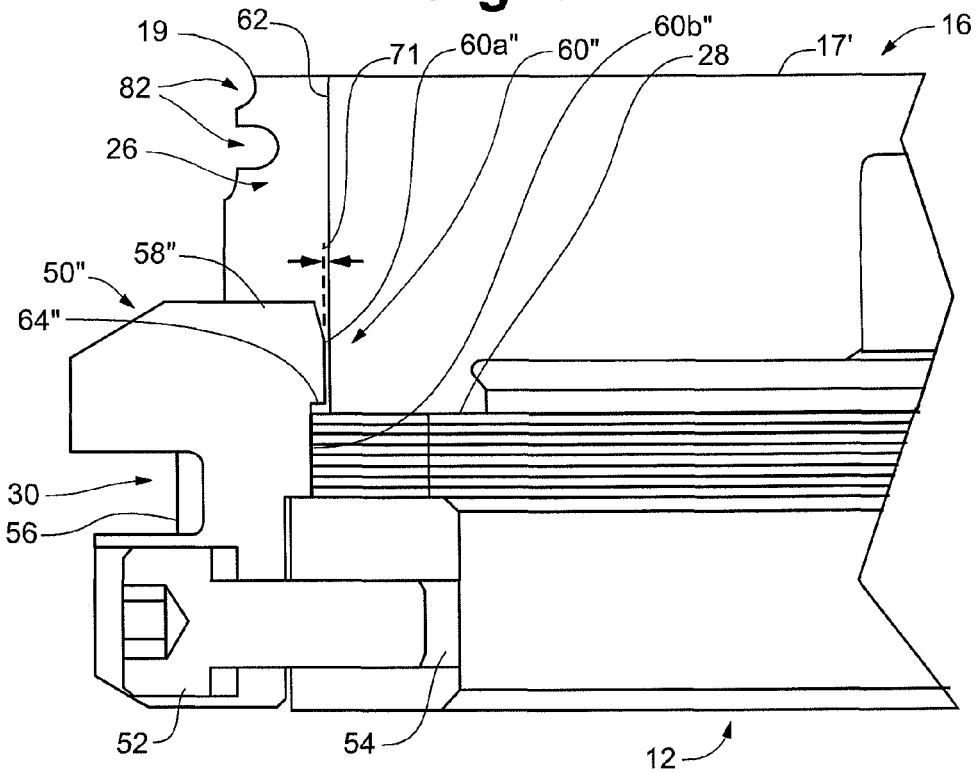
FIG. 17 is a partial view of the die shoe, key, die, and shims of FIG. 16 at a bearing surface of the die shoe.
Figure 18:
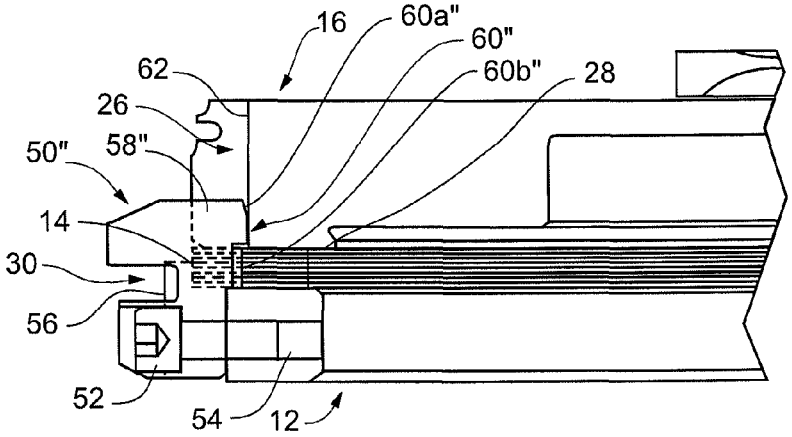
FIG. 18 is a further more detailed partial view of FIG. 16 at a bearing surface of the die shoe, with transparent view of the key being shown.
Figure 19:
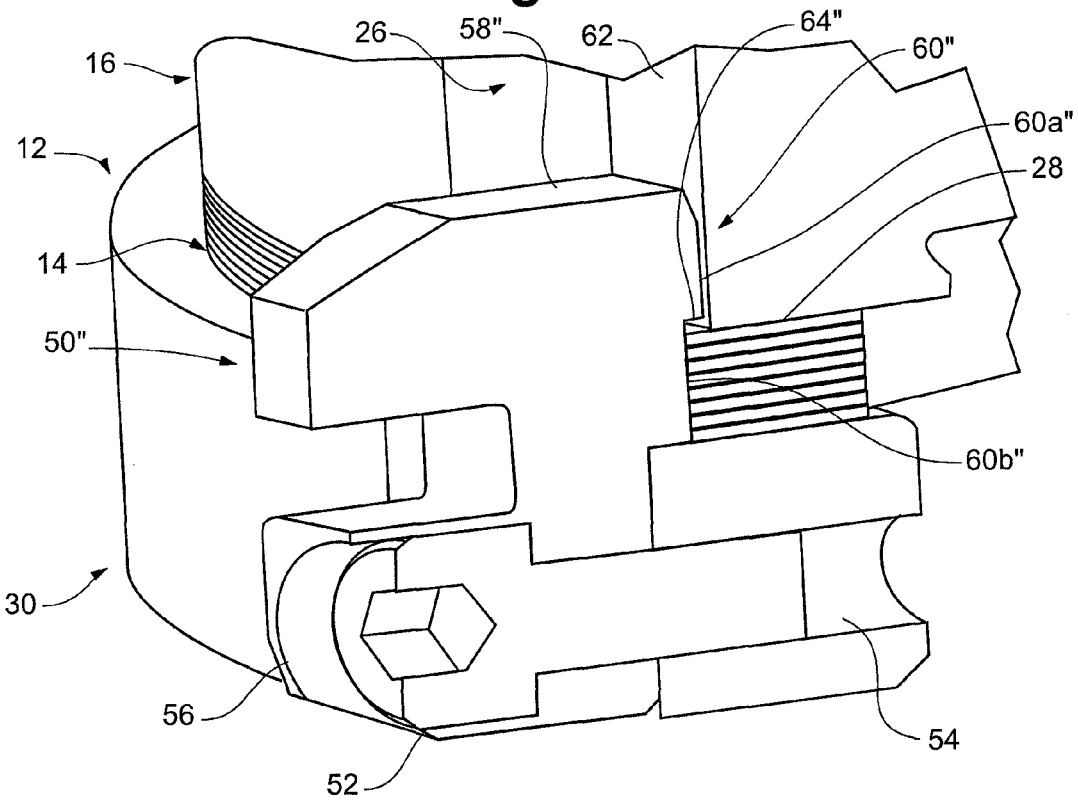
FIG. 19 is a partial perspective view of the die shoe, die, and shims of FIG. 16, showing a partial cutaway of such at a bearing surface of the die shoe, with transparent view of the key being shown.

As shown in FIGS. 7-19, each of the exemplary keys 50, 50', 50", and 50" has a portion 58, 58', 58", and 58'", respectively, which includes an extension 60, 60', 60", and 60'", respectively. The extension need not be an integral extension of the key (as is further detailed below); however, when the die 16 is mounted within the recess 14 of the die shoe 12, such extension is adapted to project into the key channel 26 of the die 16 so as to be in close proximity to a back wall 62 of the key channel 26. As further detailed below, such "close proximity" between the key extension and the key channel back wall 62, in certain embodiments, can involve slight clearance between the extension 60'" and the back wall 62 (as shown in FIGS. 16-18), or in alternate embodiments, can involve continual contact between the extension 60, 60', 60" and the back wall 62 (as shown in FIGS. 7B, 8B, and 12, respectively). In certain embodiments, as shown in FIGS. 16-19, the extension 60'" can be integral with the key 50'. Alternately, in certain embodiments, the extension can be operatively coupled to the key 50. Examples of such configuration are shown in FIGS. 7 A and 7B with reference to extension 60 and key 50, in FIGS. 8A and 8B with reference to extension 60' and key 50', and in FIGS. 9-14 with reference to extension 60" and key 50". Further, in certain embodiments, and perhaps as best shown in FIGS. 7B, 8B, 13, and 17, the keys 50, 50', 50", 50'" can respectively have a first extension 60*a*, 60*a*', 60*a*", 60*a*'" and a second extension 60*b*, 60*b*', 60*b*", 60*b*'" wherein the first extension 60*a*, 60*a*', 60*a*", 60*a*'" is adapted to be in close proximity to the key channel back wall 62, while the second extension 60*b*, 60*b*', 60*b*", 60*b*'" is recessed by comparison in order to function with the shims 28 positioned between the die 16 and the die shoe 12 (as further detailed below).

As should be appreciated from FIGS. 7-19, in using the keys 50, 50', 50", and 50'" with the die 16 (when positioned in the die shoe 12), the key's extension 60, 60', 60", and 60'", respectively, is in close proximity to the back wall 62 of the die's key channel 26, regardless of extent by which the die 16 has been sharpened. For example, as illustrated in FIGS. 7A and 7B, a plurality of shims 28 are positioned between the die 16 and the die shoe 12. Consequently, with reference to FIG. 7B, the height of the die 16 can be raised in the die shoe 12 such that there is no longer appreciable contact between the die outer side surface 20 and the recess outer surface 18 of the die shoe 12 at the key side 30. While this circumstance, as described above, would conventionally create a scenario in which the die 16 is free to laterally move from its initial position in the die shoe 12, the key 50 limits such movement. In particular, the key extension 60 and the key channel back wall 62 are kept in close proximity (and in the case of key 50, in continual contact) that upon the above-described scenario arising, the key extension 60 limits the amount of lateral movement of the die 16 in the direction of the key 50, thereby keeping the die 16 in workable vertical alignment with the die shoe 12. Accordingly, the key 50 provides a form of back-up means of keeping the die 16 in workable position with respect to the die shoe 12 in the event the die 16 is raised (via use of the shims 28) out of the die shoe's recess 14. This same effect applies with use of the key 50' as shown in FIGS. 8A and 8B, the key 50" as shown in FIGS. 9-15, and the key 50'" as shown in FIGS. 16-19.

As described above, with reference to embodiments of the keys 50, 50', 50", and 50'" in which first and second extensions 60*a*, 60*a*', 60*a*", 60*a*'" and 60*b*, 60*b*', 60*b*", 60*b*'" respectively, are provided therewith, the first and second extensions are of differing depths in relation to the die shoe 12. For example, in certain embodiments as shown in FIGS. 7A and 7B, the first extension 60*a* (in close proximity to—and in the case of key 50, in continual contact with—the back wall 62 of the die key channel 26) has a depth that is greater than the depth of the second extension 60*b*. To that end, in certain embodiments, the first extension 60*a* is located above the second extension 60*b*, thereby forming an inverted step 64 along the extension 60. Such step 64 (formed via the first extension 60*a*) forms a stop or ceiling of sorts for the shims 28 beneath the die 16 and adjacent to the second extension 60*b*. Accordingly, in the event the operator needs to pull the die 16 out from the die shoe 12, the first extension 60*a* allows the die 16 to slide out from the shoe 12, while not pulling out the shims 28 adjacent to the second extension 60*b*, as the first extension's greater depth (via the created shelf 64) prevents the shims 28 from sliding out as well. To that end, in certain embodiments, the longitudinal extent of the second extension 60*b* is of sufficient height (in relation to the die shoe 12) to retain the quantity of shims 28 needed for greatest degree of sharpening with regard to the die 16. It should be appreciated that the above also applies with use of the key 50' of FIGS. 8A and 8B, key 50" of FIGS. 9-15, and key 50'" of FIGS. 16-19, and the steps 64', 64", 64'", respectively, formed via their first and second extensions 60*a*', 60*a*", 60*a*'" and 60*b*', 60*b*", 60*b*'" respectively. However, it should also be appreciated that the invention is not limited to the above. For example, any of the first and second extensions of the keys of FIGS. 7-19 can instead have equal (or substantially equal) depths in relation to the die shoe 12.

With further reference to FIGS. 7-19, the key can be in the form of either a static mechanism or a dynamic mechanism. Such dynamic mechanism, as further described below, is in reference to the key's extension and the extension's length being adjustable. To that end, in certain embodiments, the extension's length can be manually adjustable, while in other alternative embodiments, the extension's length can automatically adjust to conform to the depth of the die key channel. For example, in certain embodiments, as shown in FIGS. 7A and 7B, the key's extension 60 can adjust automatically to a length which conforms to a depth 59 of the die key channel 26. As shown, such conforming functionality can stem from a member 66 of the extension 60 that is biased to exert force in a direction away from the key 50 and toward the die shoe recess 14. As such, when the die 16 is positioned in the die shoe 12, the biased member 66 is configured to contact and apply continual force on the back wall 62 of the die key channel 26. In cases in which the key 50 includes first and second extensions 60*a* and 60*b*, as further shown in FIG. 7B, the first extension 60*a*, in certain embodiments, can include such biased member 66. In certain embodiments, as shown in FIGS. 7A and 7B, the member 66 can be a spring loaded element, such as a ball. However, it should be appreciated that other biased members (e.g., a pin) and/or biasing means (e.g., via hydraulics) can alternately be used.

Figure 13:
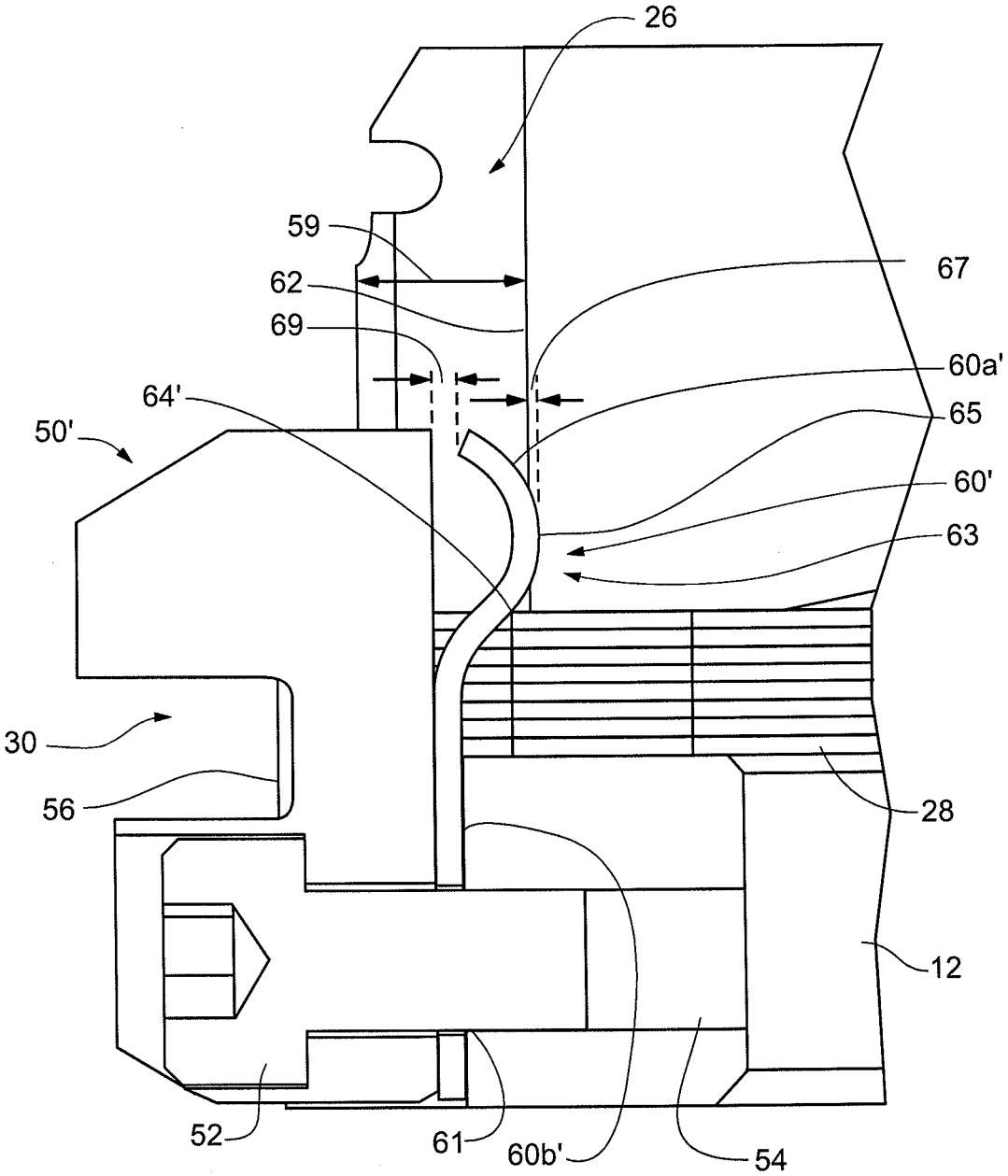
FIG. 13 is a partial cross-sectional view of the die shoe, key, and die of FIG. 11 with the die's height raised in relation to the die shoe via use of an increased quantity of the shims in accordance with certain embodiments of the invention.
Figure 14:
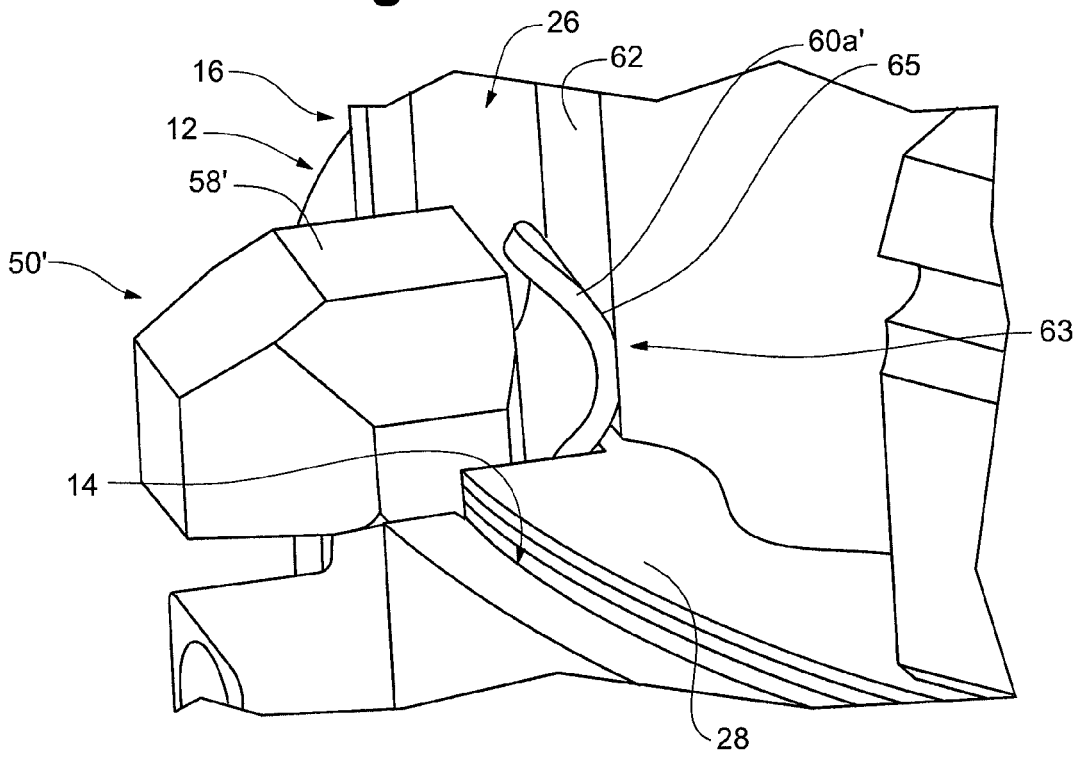
FIG. 14 is a partial perspective view of the die shoe, key, die, and shims of FIG. 13, showing a partial cutaway of such at a bearing surface of the die shoe.
Figure 15:
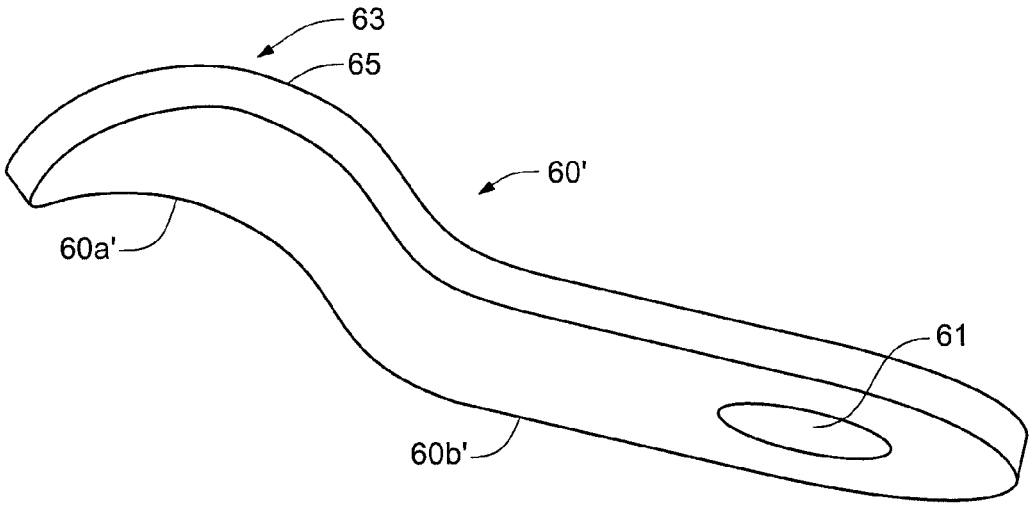
FIG. 15 is a side perspective view of an extension of the key of FIG. 9.

FIGS. 9-15 illustrate a further exemplary form of dynamic mechanism for the key 50", in which the key's extension 60" can also automatically adjust to a length which conforms to the depth 59 of the die key channel 26. As shown, the key's extension 60" involves a tongue-shaped member that is operatively coupled to the key 50". To that end, in certain embodiments as shown in FIGS. 13 and 15, the extension 60" defines a bore 61 therein, through which fastening means can be passed, for securing the extension 60" to the die shoe 12. In certain embodiments, as further shown in FIG. 13, the fastening means can involve the threaded fastener 52 used for operatively coupling the key 50" to the die shoe 12 (as described above), thereby retaining the extension 60" between the key 50" and the shoe 12. However, it should be appreciated that other fastening means and/or other manners of coupling the extension 60" to the key 50" can alternatively be employed.

Figure 9:
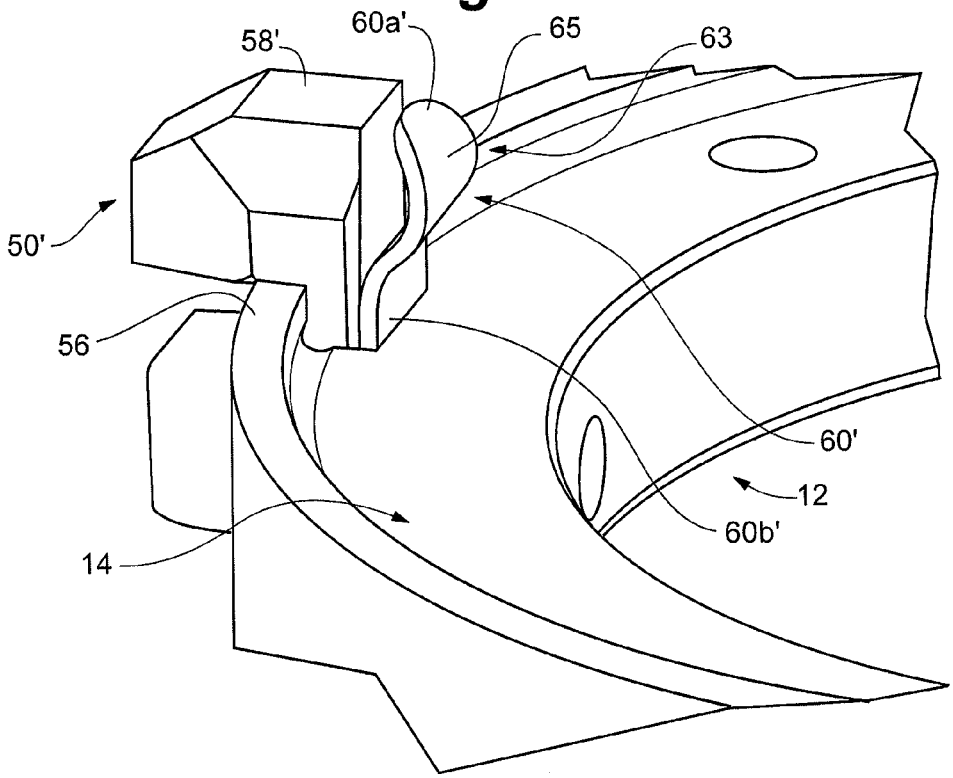
FIG. 9 is a partial perspective view of the die shoe of FIG. 1 and further key in accordance with certain embodiments of the invention.
Figure 10:
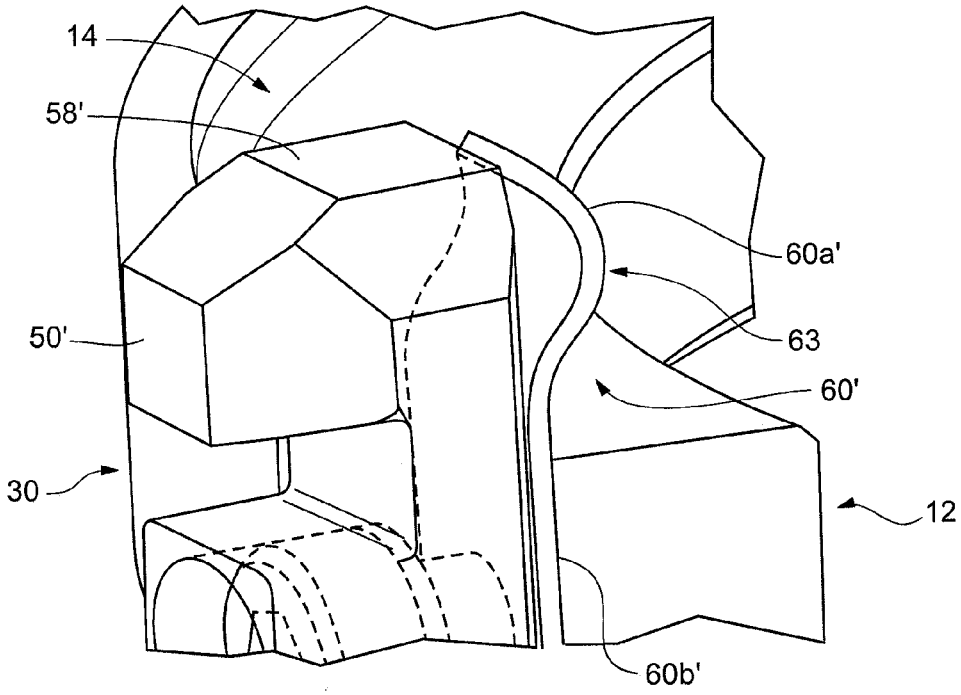
FIG. 10 is a partial cross-sectional view of the die shoe and key of FIG. 9, with transparent view of the key being shown.

The extension 60", while not having a biased member, includes a bend portion 63. As illustrated in FIG. 9, the extension 60" (when mounted to the key 50" that is in turn used with die shoe 12) projects force in a direction away from the key 50" and toward the die shoe recess 14. With reference to FIGS. 9-11, in certain embodiments, such bend portion 63 is concave in shape, with its outer surface 65 curving away from the key 50". In certain embodiments, the bend portion 63 has a radius of at least 0.1 inch, and perhaps more preferably, at least 0.15 inch. In curving away from the key 50", the outer surface 65 of the bend portion 63 is configured to extend into the die shoe recess 14. In turn, upon positioning the die 16 in the die shoe recess 14, the extension 60" automatically adjusts to a length that conforms to the depth 59 of the key channel 26 (via contact with the back wall 62 of the channel 26). As shown in FIG. 13, in certain embodiments, the extension 60" projects away from the key 50" and toward the die shoe recess 14 by a distance 67 greater that the depth of the die key channel 26 (when the die 16 is positioned in the die shoe recess 14). In certain embodiments, as shown in FIGS. 13 and 14, such distance 67 is at least 0.007 inch, and more preferably, at least 0.01 inch. Accordingly, when the die 16 is positioned in the die shoe recess 14, the outer surface 65 of the bend portion 63 is configured to contact the key channel back wall 62 of the die 16 and project force in the direction of such wall 62. As shown, the bend portion 63 of the extension 60", perhaps as best shown in FIG. 13, terminates short of contacting the key 50", providing a clearance 69 there between. In certain embodiments, this clearance 69 can be at least 0.03 inch. As should be appreciated, such clearance 69 enables the bend portion 63 of the extension 60" to deflect back toward the key 50" to enable the die 16 to be slid into the die shoe recess 14.

It should be appreciated that while the bend portion 63 has been described as being concave in shape and curved, the invention should not be limited to such. Instead, the bend portion 63 can just as well consist of a single bend extending away from the key 50'. In cases in which the key 50" includes first and second extensions 60*a*" and 60*b*", in certain embodiments, e.g., as shown in FIG. 11, the first extension 60*a*" can include such bend portion 63, while the second extension 60*b*" can include a straight portion. The extension 60" is formed of any material with yield strength adequate to remain in an elastic state during loading and unloading of the die 16 in relation thereto. Such material preferably also needs to resist plastic deformation. In certain embodiments, such material can be unannealed spring steel; however, the invention should not be limited to such.

FIGS. 8A and 8B illustrate a further exemplary form of dynamic mechanism for the key 50', in which the key's extension 60' can be manually adjusted to a length that conforms to the depth 59 of the die key channel 26. In certain embodiments, the key's extension 60' involves a member 57 provided in a bore 55 defined in the portion 58' of the key 50'. For example, in certain embodiments as shown in FIGS. 8A and 8B, the member 57 can be a set screw and the bore 55 can be threaded in order for the set screw to be selectively adjustable therein. In such case, the member 57 can be rotated so that a segment thereof projects from the bore 55 so as to adjust the extension 60' to a length that conforms to the depth 59 of the die key channel 26. Accordingly, when the die 16 is positioned in the die shoe recess 14, the distal end 53 of the member 57 is configured to contact the key channel back wall 62 of the die 16, providing a rigid body against such wall 62 so as to prevent lateral movement of the die 16. While the member 57 is exemplified as a set screw, it should be appreciated that the invention should not be limited to such. For example, in certain embodiments, the member 57 can be a shaft-like body (e.g., of any desired shape) sized to fit within the bore 55, with a series of apertures in the member 57 over its length. In such case, different sized extents of the member 57 can be configured to project from the bore 55 as desired by aligning the apertures with a further hole extending through the portion 58' of the key 50' and using a pin to pass through the hole and one of the apertures to lock the member 57 in position as desired.

Alternately, in certain embodiments, as shown in FIGS. 16-19, the key 50'" can take the form of a static mechanism, whereby the key extension 60'" is rigid (without an automatically conforming member or manually adjustable member). In such embodiments, the extension 60'" provides clearance 71 between the key 50'" and the channel back wall 62 of the die 16, while still enabling the die 16 to be kept in workable vertical alignment with the die shoe 12. As described above, and perhaps best shown in FIG. 17, this clearance 71 can allow for a limited degree of lateral movement of the die 16 if raised out of the die shoe's recess 14, yet limits the amount of such movement, thereby keeping the die 16 in workable vertical alignment with the die shoe 12. In certain embodiments, the clearance 71 between the extension 60''' and the back wall 62 of the die key channel 26 is at least about 0.005 inch, and perhaps more preferably, between at least about 0.005 inch and 0.01 inch.

Therefore, when using cartridges, issues that have been conventionally found to develop with respect to the die shoe can be addressed using embodied key 50 of FIGS. 6-7, key 50' of FIG. 8, key 50" of FIGS. 9-15, and key 50" of FIGS. 16-19 (or other key designs with differing combinations of the features of keys 50, 50', 50", and 50'''). Additionally, when using the keys 50, 50', 50", and 50''', the die 16 can be freely inserted and removed from the die shoe 12 only with actions directed to the die 16, upon which the key extensions 60', 60''' of respective keys 50', 50" enables such die insertion/removal, or upon which the key extensions 60 and 60" of respective keys 50, 50" automatically deflect or recoil in response to enable such insertion/removal of the die 16. As has already been detailed, the conventional issues found to develop with respect to the die shoe are largely predicated by the need to repeatedly sharpen the die over its useful life. To that end, further issues can come to surface with respect to the die (and its resultant upper surface) following such sharpening processes. In addressing these further issues, attention is given to FIGS. 6 and 19-20.

As alluded to above with reference to FIG. 6, the die 16 is repeatedly sharpened over its life (usually maximum sharpening depths of 1 mm) during its use with the die shoe 12. To that end, sharpening of the die 16 generally needs to take place to keep its upper surface generally planar for processing workpieces thereon. However, when a die is sharpened, edges of its upper surface can become jagged or sharp. Such jagged edges can be found to interfere with workpieces slid across the die's upper surface, with the workpieces catching against the edges. Such catching, which often represents jarring contact between a workpiece and the die's surface, can tend to adversely affect the subsequent machining process, via improper positioning of the workpiece and/or, in some cases, movement of the die (depending on size of the workpiece). To that end, the subsequent machining process is either compromised or completely averted due to error being sensed. It should be understood that use of embodied keys 50, 50', and 50" would limit jarring movement of the die 16; however, the press tooling would be further enhanced if the incidence of jarring contact between workpieces and the die 16 could be minimized, if not altogether prevented.

Figure 20:
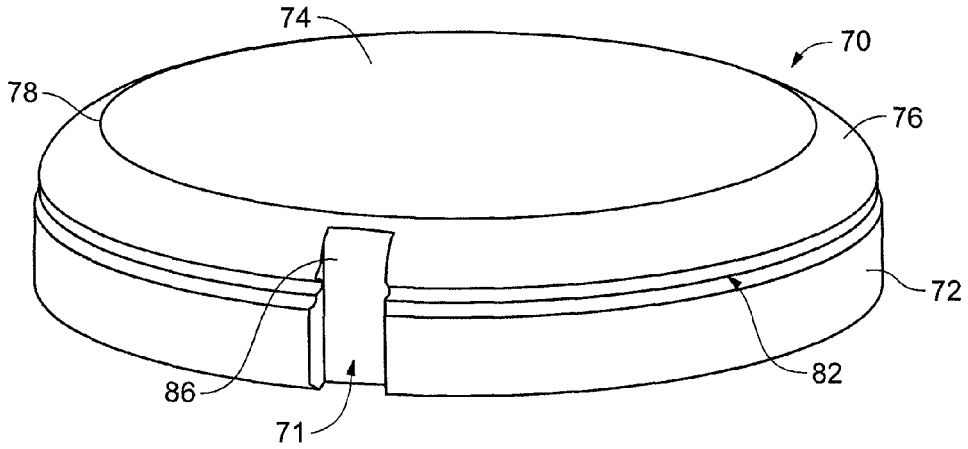
FIG. 20 is a perspective view of a die prior to being sharpened in accordance with certain embodiments of the invention.
Figure 21:
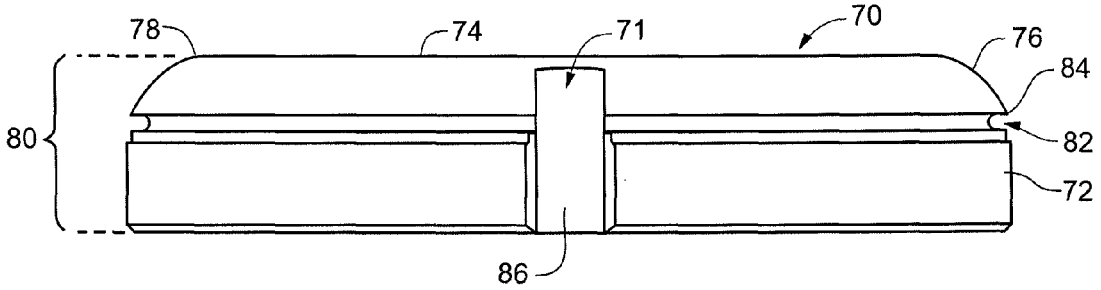
FIG. 21 is a front view of the die of FIG. 20.

In addressing the above problem, FIGS. 20 and 21 show views of a new die 70 (prior to being sharpened) in accordance with certain embodiments of the invention. As shown, the die 70 can share some features presently found in the conventional die type, such as the die 16 shown in FIGS. 2-8, 11-14, and 16-19. For example, the die 70 includes a key channel 71 extending vertically along the outer side surface 72 of the die 70. In addition, the initial height of the die 70 is generally similar to the initial height of the conventional die 16. As such, the useful life of the die 70 is generally the same as the life of the conventional die 16. Further, the circumference of the die 70 is generally similar to the circumference of the conventional die 16, thereby enabling it to be readily adapted with conventional die shoes, such as die shoe 12. However, the die 70 also has significant distinctions from the conventional die 16.

For example, as compared to conventional dies (such as the die 16), the die 70 shown in FIGS. 20 and 21 has a smooth profile as it extends away from its upper surface 74. In particular, the die 70 has a smooth continuous portion 76 that curves downwardly from the edge 78 of the die's upper surface 74 and extends along the die's outer side surface 72. In certain embodiments, such portion 76 extends along at least about $1/5^{th}$ of the die's original unsharpened height 80, and perhaps more preferably, at least about $1/4^{th}$ of the die's original unsharpened height 80, and perhaps even more preferably, at least about $1/3^{rd}$ of the die's original unsharpened height 80. Contrast this with the profile of the conventional die 16, e.g., as illustrated in FIGS. 7 and 8, which involves a series of grooves 82 provided along the die's outer side surface 20 just below the die's upper surface 17.

One of the purposes of providing such grooves 82 in a die's side surface is for gripping the die, e.g., when being moved in and out of a cartridge. To that end, with reference to the conventional die 16, each groove 82 therein generally involves a notch formed around the circumference of the die 16, extending axially into the die's outer side surface 20. However, the proximity of such grooves 82 in close relation to the upper surface 17 of the conventional die 16 results in sharpening taking place along the extents of one of the grooves 82'. This is shown, for example, with reference to FIGS. 16 and 17. To that end, during such sharpening, jagged or sharp edges 19 are often formed on the die's upper surface 17'. Creation of such jagged or sharp edges 19 can be avoided in a number of ways using the die 70.

For example, while sharpening across grooves 82 in dies is likely to result in jagged or sharp edges being created on the sharpened surface, sharpening die surfaces having generally smooth side surfaces results in a limited potential of creating such edges. Thus, in certain embodiments as shown in FIGS. 20 and 21 and as described above, the die 70 is provided with grooves 82 a fair distance below the die's upper surface 74. In certain embodiments, the upper edge 84 of the uppermost groove 82 is located down from the die's upper surface 74 at least about $1/5^{th}$ of the die's original unsharpened height 80, and perhaps more preferably, at least about $1/4^{th}$ of the die's original unsharpened height 80, and perhaps even more preferably, at least about $1/3^{rd}$ of the die's original unsharpened height 80. Consequently, a series of sharpening processes can be performed on the die 70 prior to the grooves 82 being reached, minimizing potential of creating jagged or sharp edges in the die 70 via such sharpening and maximizing the series of sharpening processes that can be conducted on the die 70. For example, the die 70 can be sharpened at least two times and generally at least four times more than standard sharpening recommendations for dies.

In addition, while the conventional die 16, prior to being sharpened, has a series of such grooves 82 provided in side-by-side manner in the die's outer side surface 20 (e.g., as illustrated in FIGS. 6-8), the die 70 shown in FIGS. 20 and 21 is without any grooves 82 provided thereon in such side-by-side manner. As such, upon reaching one of the grooves 82 on the die 70, a sharpening process can be performed on the die 70 so as to sharpen around the entire height of the grove 82, thereby avoiding the condition for creating jagged or sharp edges there from. Further, the die 70 is provided with a limited quantity of grooves 82. In particular, as shown in FIG. 21, the die 70 has only a single groove 82 in the die's outer side surface 72. Accordingly, the condition for creating jagged or sharp edges in sharpening of the die 70 is further minimized.

Figure 22:
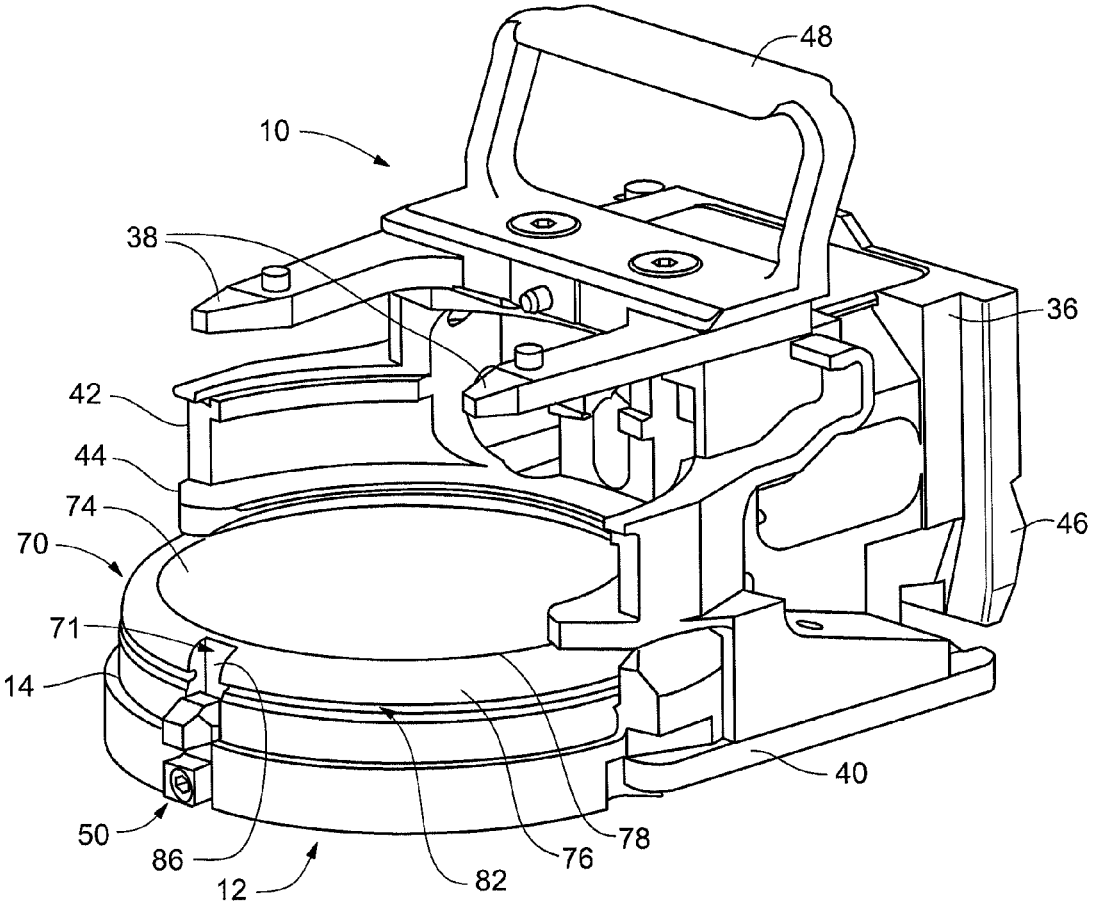
FIG. 22 is a perspective view of the die of FIG. 20 positioned in a die shoe of FIG. 6, both held in a tool set cartridge, in accordance with certain embodiments of the invention.
Figure 23:
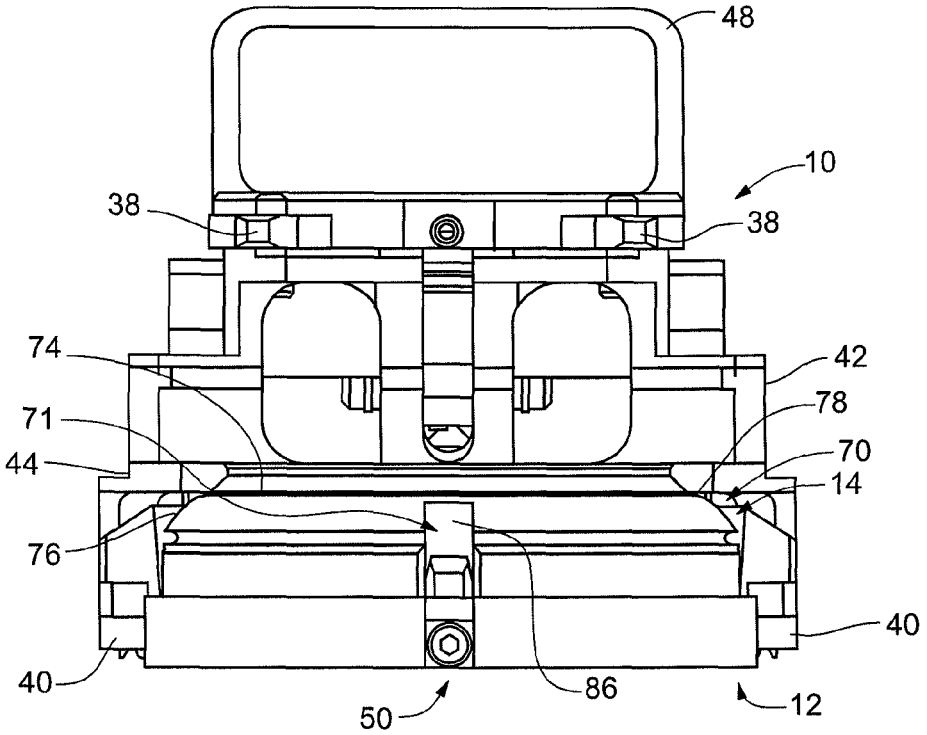
FIG. 23 is a front view of assembly of the die, the die shoe, and the cartridge of FIG. 22.
Figure 24:
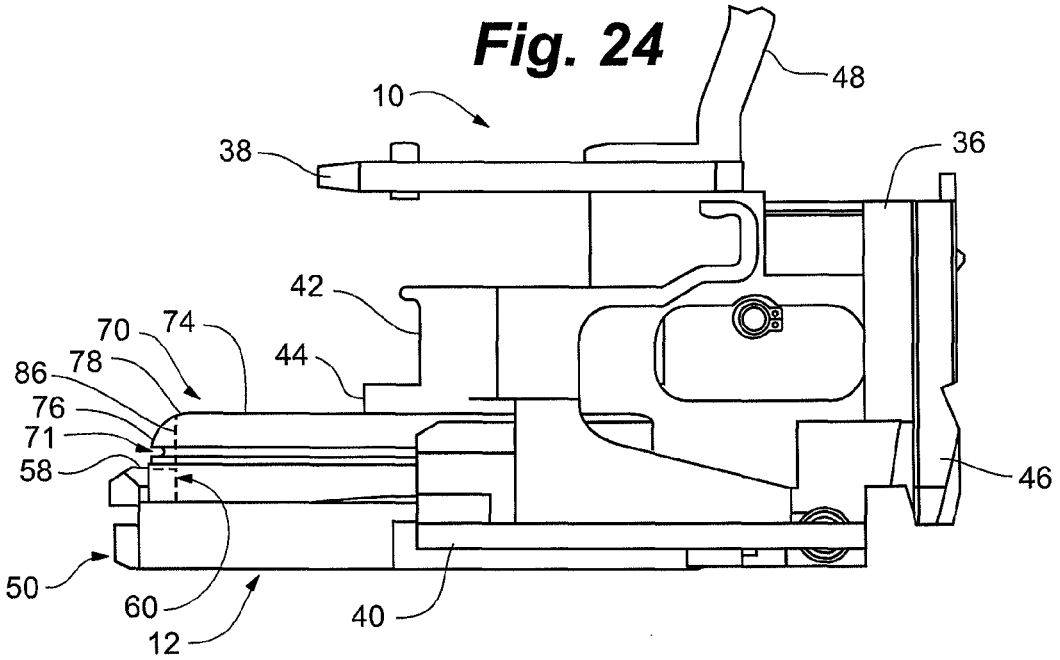
FIG. 24 is a side view of assembly of the die, the die shoe, and the cartridge of FIG. 22, with transparent view of the key being shown.

FIGS. 22-24 show views of the die 70 of FIGS. 20 and 21, positioned in the die shoe 12 held in the tool set cartridge 10 and utilizing the key 50 of FIGS. 6-8, in accordance with certain embodiments of the invention. However, as detailed above, the keys 50' or 50" of FIGS. 9-15 and 16-19, respectively, could be instead used for the key 50. As shown in FIG. 24, when the die 70 is mounted within the recess 14

(not visibly shown) of the die shoe 12, the extension 60 of the key's upper portion 58 axially projects into the key channel 71 of the die 70 so as to be in close proximity with (and in this case, contact) a back wall 86 of the key channel 71. This close proximity, maintained between the key extension 60 and the back wall 86 of the key channel 71 prevents lateral movement of the die 70 toward the key 50, even in the event the die 71 is raised (via use of the shims 28) out of the die shoe's recess 14.

The die 70, with a smooth continuous portion 76 that curves downwardly from the edge 78 of the die's upper surface 74 and extends along the die's outer side surface 72, is prone to limit the potential of creating jagged or sharp edges when sharpening the die 70. Furthermore, when used in conjunction with die shoe 12 and key 50, the die 70 is prevented from lateral movement within the shoe 12. Therefore, even if unintended jarring contact between a workpiece and the die's surface were to occur, wherefrom movement of the die would be known to result, such movement is prevented via use of the key 50.

Thus, embodiments of a DIE SHOE ASSEMBLY WITH BEARING SURFACE MECHANISM, AND DIE FOR USE THEREWITH are disclosed. One skilled in the art will appreciate that the invention can be practiced with embodiments other than those disclosed. The disclosed embodiments are presented for purposes of illustration and not limitation, and the invention is limited only by the claims that follow.

What is claimed is:

1. An apparatus for retaining a die, the apparatus comprising:

a die shoe defining an inner recess sized to at least partially accommodate a depth of a die, the die shoe including a key held stationary to one side of the die shoe, the inner recess having a depth that is less at the one side than at an opposing side of the die shoe, wherein the key has an extension that projects toward the inner recess and is adapted to extend into a key channel of the die when the die is placed in the die shoe recess;

wherein the extension is adapted to limit lateral movement of the die so that the die is maintained in workable vertical alignment with the die shoe including configurations in which the die is vertically adjusted beyond the depth of the inner recess at the one side of the die shoe, said alignment being maintained via a combination of the extension extending into the key channel of the die at the one side of the die shoe and contact being maintained between the die and the opposing side of the die shoe.

2. The apparatus of claim 1 wherein the die shoe is configured for being held by a tool set cartridge, each of opposing sides of the die shoe having a seat therein with which a die-retention arm of the cartridge is adapted to align.

3. The apparatus of claim 1 wherein the key is operatively coupled to the die shoe via a fastener.

4. The apparatus of claim 1 wherein the extension is at least in part operatively coupled to the key.

5. The apparatus of claim 1 wherein the extension projects into the die shoe recess by which a distal end of the extension is in close proximity to a back wall of the die key channel when the die is placed in the die shoe recess.

6. The apparatus of claim 5 wherein the extension projects into the die shoe recess by which the distal end of the extension contacts the back wall of the die key channel when the die is placed in the die shoe recess.

7. The apparatus of claim 1 wherein the extension has an automatically adjustable length, the length being automatically adjustable so as to conform to a depth of the die key channel when the die is placed in the die shoe recess.

8. The apparatus of claim 7 wherein the extension comprises a member configured to automatically adjust the length of the extension, wherein the member comprises a biased member that is biased toward the inner recess of the die shoe and thereby adapted to exert continual force on a back wall of the die key channel when the die is placed in the die shoe recess.

9. The apparatus of claim 7 wherein the member is retained between the key and the die shoe, the extension having a bend portion that extends into the die shoe recess and is adapted to exert continual force on the back wall of the die key channel when placed in the die shoe recess.

10. The apparatus of claim 6 wherein the extension includes a member configured to be manually adjusted to extend a length of the extension so as to conform to a depth of the die key channel.

11. The apparatus of claim 1 wherein the die shoe recess is sized to accommodate one or more shims between the die and die shoe for raising height of the die in the die shoe.

12. The apparatus of claim 11 wherein the extension comprises a first extension and a second extension, wherein the first extension is adapted to be in close proximity to a back wall of the die key channel when the die is placed in the die shoe recess and the second extension is correspondingly adapted to be in close proximity to key channels of the one or more shims when positioned in the die shoe recess between the die and the die shoe.

13. The apparatus of claim 12 wherein the first extension includes a dynamic mechanism adapted to exert continual force on the back wall of the die key channel.

14. The apparatus of claim 13 wherein the dynamic mechanism comprises a biased member.

15. The apparatus of claim 13 wherein the dynamic mechanism comprises a bend portion.

16. The apparatus of claim 12 wherein the first extension and the second extension form a stop there between, the stop configured to retain the one or more shims within the die shoe recess when the die is removed from the die shoe.

17. The apparatus of claim 16 wherein the first and second extensions are each defined with differing depths relative to an inner surface of the die shoe, the depth of the first extension being greater than the depth of the second extension, the stop comprising a shoulder between the first and second extensions.

18. The apparatus of claim 1 wherein the one side of the die shoe has a lower height than one or more of adjacent and opposing sides of the die shoe.

19. An apparatus for retaining a die, the apparatus comprising:

a die shoe defining an inner recess sized to at least partially accommodate a depth of a die, the die shoe including a key held stationary to one side of the die shoe, the inner recess having a depth that is less at the one side than at an opposing side of the die shoe, wherein the key includes a dynamic mechanism that projects toward the inner recess and is adapted to extend into a key channel of the die when the die is placed in the die shoe recess;

wherein the mechanism has an automatically adjustable length, the length being automatically adjustable to conform to a depth of the key channel of the die, whereby the mechanism is adapted to prevent lateral movement of the die relative to the die shoe so that the die is maintained in workable vertical alignment with the die shoe including configurations in which the die is vertically adjusted beyond the depth of the inner recess die shoe at the one side of the die shoe, said alignment being maintained via a combination of contact between the mechanism and a back wall of the key channel of the die at the one side of the die shoe and contact between the die and the opposing side of the die shoe.

20. The apparatus of claim 19 wherein the dynamic mechanism comprises a member configured to automatically adjust the length of the dynamic mechanism so as to conform to the depth of the die key channel.

21. The apparatus of claim 20 wherein the member comprises a biased member projecting force in a direction toward the die shoe recess, the biased member adapted to exert continual force on the back wall of the die key channel when the die is placed in the die shoe recess.

22. The apparatus of claim 21 wherein the biased member comprises a spring loaded element.

23. The apparatus of claim 22 wherein the spring loaded element comprises a ball.

24. The apparatus of claim 20 wherein the dynamic mechanism has a bend portion that extends into the die shoe recess and is adapted to exert continual force on the back wall of the die key channel when the die is placed in the die shoe recess.

25. The apparatus of claim 24 wherein the bend portion is concave in shape, having an outer surface curving away from the key.

26. The apparatus of claim 24 wherein the bend portion extends into the die shoe recess a distance greater than a depth of the die key channel of the die.

27. The apparatus of claim 19 wherein the dynamic mechanism comprises a member configured to be manually adjusted to extend a length of the dynamic mechanism so as to conform to a depth of the die key channel.

28. An apparatus for retaining a die, the apparatus usable with one or more shims for adjusting height of the die, the apparatus comprising:

one or more shims; and a die shoe defining an inner recess with a depth sized to at least partially accommodate a depth of a die or the die positioned on the one or more shims so as to raise height of the die relative to the die shoe inner recess, the die shoe including a key held stationary to one side of the die shoe, wherein the key has an extension that projects toward the inner recess;

wherein the extension comprises a first extension and a second extension, the first extension adapted to extend into a key channel of the die when the die is placed in the die shoe recess and the second extension adapted to extend into a key channel of each of the one or more shims when the one or more shims are placed in the die shoe inner recess between the die and the die shoe, the first extension and the second extension having different lengths projecting within the die shoe inner recess, whereby the first extension is configured to extend over the one or more shims within the depth of the die shoe inner recess so as permit removal of the die from the die shoe separate from the one or more shims.

29. The apparatus of claim 28 wherein the first extension includes a dynamic mechanism adapted to exert continual force on a back wall of the die key channel.

30. The apparatus of claim 29 wherein the dynamic mechanism comprises a biased member.

31. The apparatus of claim 29 wherein the dynamic mechanism comprises a bend portion.

32. The apparatus of claim 29 wherein the mechanism has an automatically adjustable length, the length being adjustable to conform to a depth of the key channel of the die, whereby the mechanism is adapted to prevent lateral movement of the die relative to the die shoe so that the die is maintained in workable vertical alignment with the die shoe including configurations in which the die is vertically adjusted outside the depth of the die shoe inner recess, said alignment being maintained via contact between the mechanism and the back wall of the key channel of the die at the one side of the die shoe and contact between the die and an opposing side of the die shoe.

33. The apparatus of claim 28 wherein the first extension is configured to extend over the one or more shims when raised outside the depth of the die shoe inner recess so as permit removal of the die from the die shoe separate from the one or more dies.

34. A method of retaining a die with a die shoe, the method comprising:

providing a die shoe defining an inner recess sized to at least partially accommodate a depth of a die, the die shoe including a key rigidly joined to one side of the die shoe, the inner recess having a depth that is less at the one side than at an opposing side of the die shoe, wherein the key has an extension that projects toward the inner recess and is adapted to extend into a key channel of the die when the die is placed in the die shoe recess; and positioning the die in the die shoe recess, the extension including a member configured to automatically adjust a length of the extension so as to conform to a depth of the die key channel, wherein the extension is adapted to limit lateral movement of the die so that the die is maintained in workable vertical alignment with the die shoe including configurations in which the die is positioned on one or more shims in the die shoe inner recess and adjusted beyond the depth of the inner recess at the one side of the die shoe, said alignment being maintained via a combination of contact between the extension and a back wall of the key channel of the die at the one side of the die shoe and contact between the die and the opposing side of the die shoe.

35. The method of claim 34 further comprising the step of inserting the die shoe in a tool set cartridge, wherein each of die-retention arms of the cartridge are biased to pivot in adjacent seats of the die shoe.

36. The method of claim 34 wherein the member comprises a dynamic mechanism that exerts continual force on the back wall of the die key channel.

37. The method of claim 34 wherein the extension comprises a first extension and a second extension, wherein the first extension includes the member and the second extension extends into a key channel of each of the one or more shims.

38. The method of claim 37 wherein the first extension and the second extension have different lengths projecting within the die shoe inner recess, whereby the first extension is configured to extend over the one or more shims within the die shoe inner recess so as permit removal of the die from the die shoe inner recess separate from the one or more dies.

39. An apparatus for retaining a die, the apparatus comprising:

a die shoe defining an inner recess sized to at least partially accommodate a depth of a die, the die shoe including a key rigidly joined to one side of the die shoe, the inner recess having a depth that is less at the one side than at an opposing side of the die shoe, wherein the key has a height greater than a height of the one side of the die shoe and comprises an extension that projects toward the inner recess and is adapted to extend into a key channel of the die when the die is placed in the die shoe recess;

wherein the extension includes a member configured to automatically adjust a length of the extension so as to conform to a depth of the die key channel when the die is placed in the die shoe recess; and wherein the extension is adapted to limit lateral movement of the die so that the die is maintained in workable vertical alignment with the die shoe including configurations in which the die is positioned on one or more shims in the die shoe inner recess and adjusted beyond the depth of the inner recess at the one side of the die shoe, said alignment being maintained via a combination of contact between the extension and a back wall of the key channel of the die at the one side of the die shoe and contact between the die and the opposing side of the die shoe.

40. The apparatus of claim 39 wherein the key is operatively coupled to the die shoe via a fastener.

41. The apparatus of claim 39 wherein the member is biased toward the inner recess of the die shoe and thereby adapted to exert continual force on the back wall of the die key channel when the die is placed in the die shoe recess.

42. The apparatus of claim 39 wherein the die shoe recess is sized to accommodate the one or more shims between the die and die shoe for raising height of the die in the die shoe.

* * * * *